US012221781B2

(12) United States Patent
Gershman et al.

(10) Patent No.: US 12,221,781 B2
(45) Date of Patent: Feb. 11, 2025

(54) SYSTEMS AND METHODS FOR UNDERGROUND STORAGE OF STORM AND OTHER WATER SOURCES

(71) Applicant: Underground Industries LLC, Indianapolis, IN (US)

(72) Inventors: Ryan Gershman, Indianapolis, IN (US); Jason Sheasley, Indianapolis, IN (US); Matthew Rubin, Indianapolis, IN (US); Carroll Weisiger, Indianapolis, IN (US); Alen Fetahagic, Indianapolis, IN (US)

(73) Assignee: Underground Industries LLC, Indianapolis, IN (US)

( * ) Notice: Subject to any disclaimer, the term of this patent is extended or adjusted under 35 U.S.C. 154(b) by 0 days.

(21) Appl. No.: 18/460,108

(22) Filed: Sep. 1, 2023

(65) Prior Publication Data

US 2023/0407617 A1 Dec. 21, 2023

Related U.S. Application Data

(63) Continuation of application No. 18/161,320, filed on Jan. 30, 2023, now Pat. No. 11,846,094.

(60) Provisional application No. 63/406,417, filed on Sep. 14, 2022, provisional application No. 63/357,947, filed on Jul. 1, 2022, provisional application No. 63/310,357, filed on Feb. 15, 2022, provisional application No. 63/304,399, filed on Jan. 28, 2022.

(51) Int. Cl.
*E03F 1/00* (2006.01)

(52) U.S. Cl.
CPC ..... *E03F 1/002* (2013.01)

(58) Field of Classification Search
CPC ..... E03F 1/002
See application file for complete search history.

(56) References Cited

U.S. PATENT DOCUMENTS 3,919,848 A * 11/1975 Sullivan ..... E03F 1/002 210/170.08
4,693,300 A 9/1987 Adachi
4,919,568 A 4/1990 Hurley
4,934,404 A 6/1990 DeStefano
(Continued)

FOREIGN PATENT DOCUMENTS

CN 104727424 A * 6/2015
CN 105484340 A * 4/2016
(Continued)

OTHER PUBLICATIONS

Aspect Consulting, LLC "Aquifer Storage and Recovery: An Innovative Approach to Water Storage," Feb. 10, 2016.

*Primary Examiner* — Frederick L Lagman
(74) *Attorney, Agent, or Firm* — Goodwin Procter LLP

(57) ABSTRACT

In various embodiments, the disclosure relates to a system for locating storm and/or waste water to a subsurface region. The system can be sized to replace, in some instances, retention ponds and to increase developable square footage on a region of land. The system can include a conduit for directing a volume of storm and/or waste water to a subsurface region located at least as deep as the aquifer layer. The system can be sized to handle a volume of water generated during a 100 year storm. In certain embodiments, the subsurface region is located directly below a land structure (e.g., a building structure).

23 Claims, 8 Drawing Sheets

(56) References Cited

U.S. PATENT DOCUMENTS

| | | | | | |
|---|---|---|---|---|---|
| 5,131,196 | A * | 7/1992 | Florence | E03F 1/002 | 52/16 |
| 5,195,284 | A * | 3/1993 | Florence | E03F 1/002 | 52/16 |
| 5,234,286 | A | 8/1993 | Wagner | | |
| 5,249,885 | A * | 10/1993 | Florence | E03F 1/002 | 405/38 |
| 5,735,304 | A * | 4/1998 | Chumley | E03B 3/02 | 137/15.01 |
| 5,862,633 | A | 1/1999 | Van Ells | | |
| 6,382,237 | B1 * | 5/2002 | Takai | E03B 3/02 | 220/567.1 |
| 6,467,994 | B1 | 10/2002 | Ankeny et al. | | |
| 6,926,464 | B1 | 8/2005 | Weidmann | | |
| 6,991,402 | B2 | 1/2006 | Burkhart | | |
| 7,029,201 | B1 | 4/2006 | McCormick et al. | | |
| 8,074,670 | B2 | 12/2011 | Peters et al. | | |
| 8,152,997 | B1 | 4/2012 | Olson et al. | | |
| 8,162,563 | B2 | 4/2012 | Shaw et al. | | |
| 8,602,687 | B2 | 12/2013 | Hubbell, Jr. | | |
| 9,593,477 | B1 * | 3/2017 | Stivers | C02F 3/327 | |
| 10,882,772 | B1 * | 1/2021 | Wensel | E03F 5/101 | |
| 11,846,094 | B2 * | 12/2023 | Gershman | E03F 1/002 | |
| 2003/0021630 | A1 * | 1/2003 | Norman | E03F 1/002 | 405/52 |
| 2009/0050215 | A1 | 2/2009 | Hayes | | |
| 2011/0253238 | A1 | 10/2011 | Burkhart, Sr. et al. | | |
| 2012/0187031 | A1 * | 7/2012 | Beatt | E03F 5/103 | 210/170.03 |
| 2014/0314485 | A1 | 10/2014 | Emborg | | |
| 2014/0346099 | A1 | 11/2014 | Brantley et al. | | |
| 2015/0218025 | A1 * | 8/2015 | Couch | C02F 3/30 | 210/170.08 |
| 2017/0225982 | A1 * | 8/2017 | Kiilerich | E03F 5/02 | |
| 2020/0173159 | A1 | 6/2020 | Iorio | | |

FOREIGN PATENT DOCUMENTS

| | | | | | |
|---|---|---|---|---|---|
| CN | 105735451 | A | * | 7/2016 | |
| CN | 107237388 | A | * | 10/2017 | E03F 1/00 |
| CN | 107761897 | A | | 3/2018 | |
| CN | 107905331 | A | | 4/2018 | |
| CN | 108560679 | A | * | 9/2018 | |
| CN | 109577450 | A | * | 4/2019 | E03F 1/00 |
| CN | 210194738 | U | | 3/2020 | |
| CN | 112814120 | A | * | 5/2021 | B01D 35/02 |
| CN | 113863465 | A | * | 12/2021 | |
| DE | 20207819 | U1 | | 11/2002 | |
| EP | 2333217 | A1 | | 6/2011 | |
| IN | 664MU2015 | A | | 5/2015 | |
| KR | 101038336 | B1 | * | 6/2011 | |
| KR | 1574644 | | | 12/2015 | |
| KR | 1783315 | | | 10/2017 | |
| KR | 1932145 | | | 12/2018 | |
| PH | 22014000326 | Y1 | | 7/2014 | |
| WO | WO-2021130186 | A1 | | 7/2021 | |

* cited by examiner

| Parameter Chart | | | | |
|---|---|---|---|---|
| Parameter | Low Value | Nominal Value | High Value | Unit |
| Volume of Storm and/or Waste Water | 1 | 1,000,000 | 100,000,000 | Gallons |
| Flow Rate of Storm and/or Waste Water | 1/32 | 10 | 1,000 | gpm |
| Conduit Diameter | 0 | 15 | 100 | in |
| Conduit Length | 0 | 20 | 1,000 | feet |
| Conduit Wall Thickness | 0 | 0.75 | 50 | in |
| Reservoir Depth | 1 | 10 | 100 | feet |
| Reservoir Width | 1 | 10 | 10,000 | feet |
| Reservoir Capacity | 10 | 50 | 100,000,000 | Gallons |
| Trench Width | 5 | 35 | 250 | feet |
| Trench Depth | 50 | 300 | 1,000 | feet |
| Trench Capacity | 50 | 100 | 100,000,000 | Gallons |
| Event System Sized to Handle | 10 year storm | 100 year storm | 300 year storm | N/A |
| Number of Wells | 1 | 10 | 1,000 | Quantity |

FIG. 8

SYSTEMS AND METHODS FOR UNDERGROUND STORAGE OF STORM AND OTHER WATER SOURCES

CROSS-REFERENCE TO RELATED APPLICATIONS

This application claims priority to and the benefit of U.S. application Ser. No. 18/161,320, filed Jan. 30, 2023, and titled "SYSTEMS AND METHODS FOR UNDERGROUND STORAGE OF STORM AND OTHER WATER SOURCES", which claims priority to U.S. Provisional Application No. 63/406,417, filed Sep. 14, 2022, and titled "SYSTEMS AND METHODS FOR UNDERGROUND STORAGE OF STORM AND OTHER WATER SOURCES", U.S. Provisional Application No. 63/357,947, filed Jul. 1, 2022, and titled "SYSTEMS AND METHODS FOR UNDERGROUND STORAGE OF STORM AND OTHER WATER SOURCES", U.S. Provisional Application No. 63/310,357, filed Feb. 15, 2022, and titled "SYSTEMS AND METHODS FOR UNDERGROUND STORAGE OF STORM AND OTHER WATER SOURCES", and U.S. Provisional Application No. 63/304,399, filed Jan. 28, 2022, and titled "SYSTEMS AND METHODS FOR UNDERGROUND STORAGE OF STORM AND OTHER WATER SOURCES", each of which is incorporated by reference herein in their entireties.

TECHNICAL FIELD

The present subject matter generally relates to water storage. In particular, the present subject matter relates to a system and method of storing storm and/or waste water underground.

BACKGROUND

Whether via zoning requirements or otherwise, real estate owners and developers are often required to adequately plan for and manage water volumes either generated during weather events (i.e., storm water) or that is used in operation of the building (i.e., waste water). In many parts of the world, real estate owners resort to storing directing and storing such water in above-ground reservoirs, often called retention ponds. However, these retention ponds may occupy otherwise useful above-ground space. Accordingly, an improved system and method of locating stormwater and/or wastewater is needed.

SUMMARY OF THE DISCLOSURE

Applicant recognized that retention ponds can occupy valuable above-ground real estate and prevent the use of land that could otherwise be developed for other purposes, e.g., buildings/homes, roads, etc. In addition, storing the water in above-ground retention ponds does nothing to help replenish water storage structures (e.g., aquifers) beneath the surface. The present invention proposes to solve both of these problems by locating water in water storage structures beneath the surface. In general, and in various embodiments, water can be relocated into any water storage structure located beneath the surface; for example: aquifers, bedrock, bedrock aquifers, fractures in earth by way of fracking, geological features (e.g., fractures, faults, cracks), abandoned deep mines, old gas fields, salt domes, etc. While this description may describe water being located in any one of these example structures in a given embodiment (e.g., aquifers), the disclosure contemplates storage of the water in any such structure. In some examples, water can be located into multiple structures, including any combination of the examples provided herein.

In various embodiments, Applicant discovered that, despite the difficulty in accessing structures beneath the surface (e.g., drilling strength, drilling depth, additional cost, regulatory burdens, etc.), that such locations can be desirable given certain previously unappreciated advantages of such locations. While the foregoing applies to access of any underground region, Applicant further discovered that in certain cases, accessing locations beneath the aquifers can have additional benefits; for example: greater storage capacity, clearer ownership rights, etc. The skilled person would be further demotivated to access structures beneath the aquifers, given that the additional depth of such structures exacerbates many of the challenges identified above. Applicant was expressly willing to accept disadvantages that would dissuade the skilled person from considering locating water in structures beneath the surface, and in some cases even beneath the aquifers (e.g., bedrock, bedrock aquifers, etc.) in order for the new and inventive benefits discovered by Applicant.

For existing retention ponds, the invention can be used to relocate water from the ponds into the structures beneath the surface, but in other instances (e.g., new construction projects), the invention can replace retention ponds altogether. Structurally, the invention can include using piping and/or other conduits or structures to redirect storm or other waste water to a desirable location. Once at the location, the water can be moved underground using any suitable technique. In some embodiments, the water is moved underground solely under the force of gravity. In other embodiments, active pumping techniques can be used, for example, MAR wells. In still other embodiments, combinations of gravity and active pumping techniques can be used. In some implementations of such embodiments, the active pumping can supplement gravity as the primary mover, and in other implementations of such embodiments, gravity can supplement an active pump as the primary mover. Once the water is underground, piping/trenching materials (in some cases existing) can be used to funnel the water to a central location. In some embodiments, the water can be spun through aquaswirls and then treated with a combination of anaerobic treatment methods (e.g., biochar and woodchip biofilters), before being discharged into the aquifer. The invention can include use of high-speed filters using active filtration technologies.

In an aspect, a system for locating storm and/or waste water in a subsurface region is presented. The system includes a conduit for directing a volume of storm and/or waste water to a subsurface region located at a distance of at least 100 feet below a land surface. The subsurface region is located directly below a land structure.

In another aspect, a method of locating storm and/or waste water in a subsurface region is presented. The method includes directing, through a conduit, a volume of storm and/or waste water to a subsurface region located at a distance of at least 100 feet below a land surface. The subsurface region is located directly below a land structure.

These and other aspects and features of non-limiting embodiments of the present subject matter will become apparent to those skilled in the art upon review of the following description of specific non-limiting embodiments of the subject matter in conjunction with the accompanying drawings.

BRIEF DESCRIPTION OF THE DRAWINGS

FIG. 8 is a parameter chart listing exemplary low, nominal, and high values of various parameters related to the water locating system, according to various embodiments.

DETAILED DESCRIPTION

In the following description, for the purposes of explanation, numerous specific details are set forth in order to provide a thorough understanding of the present subject matter. It will be apparent, however, that the present subject matter may be practiced without these specific details. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

At a high level, aspects of the present disclosure are related to locating storm and/or waste water. Aspects of the present disclosure may be used to locate water beneath one or more land structures. In an embodiment, aspects of the present disclosure may be used to increase land utilization by eliminating a need for storing water above ground. In an aspect, the present disclosure may be used to increase volumes of usable water in wells and/or reservoirs.

Figure 1:
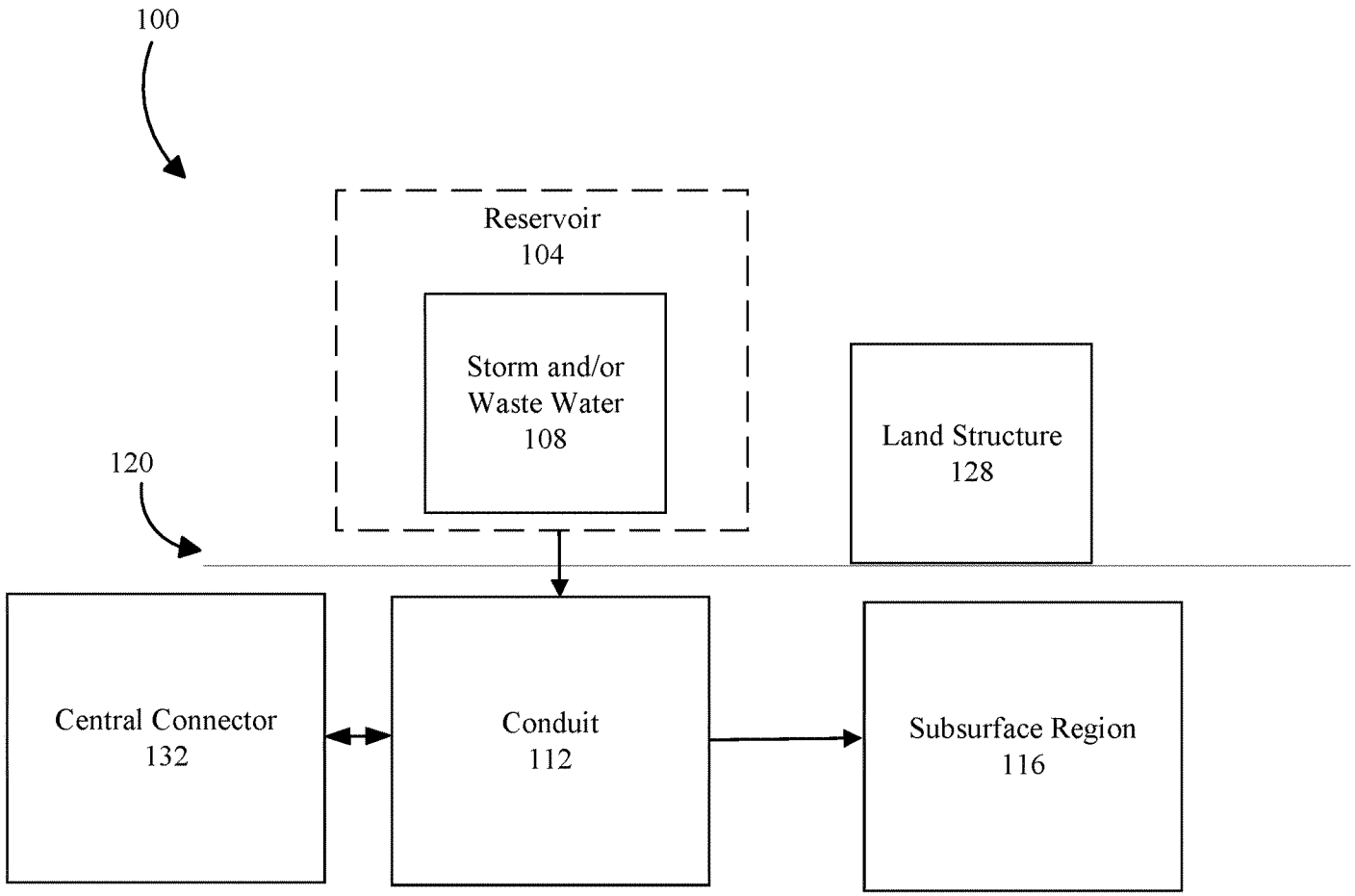
FIG. 1 is a block diagram of a system for locating storm and/or wastewater in a subsurface region, according to various embodiments.

FIG. 1 depicts an exemplary embodiment of a system 100 for relocating and storing fluid. System 100 may include reservoir 104. A "reservoir" as used in this disclosure is any vessel that can contain a volume of fluid. While FIG. 1 depicts the reservoir 104 as being located outside land structure 128, in other embodiments the reservoir 128 can be located within the land structure 128. Reservoir 104 may include a water reservoir, such as, but not limited to, a rainwater reservoir, a retention pond, etc. Reservoir 104 may include a well or other water containing structure. Reservoir 104 may include a shape, for instance and without limitation, a rectangular, circular, ovular, square, and/or other shapes. Reservoir 104 may include one or more walls. In some embodiments, reservoir 104 may include three or more walls. Walls of reservoir 104 may be oriented in, but not limited to, horizontal orientations, vertical orientations, and/or a combination thereof. In some embodiments, reservoir 104 may include two walls oriented in a vertical position and faced opposite one another. Walls of reservoir 104 may be made of material such as, without limitation, cement, metal, plastic, dirt, and/or a combination thereof. For instance, and without limitation, walls of reservoir 104 may include baffle walls. Each wall of reservoir 104 may be non-porous such that fluid may be trapped within reservoir 104. In some embodiments, reservoir 104 may include a top portion. A top portion of reservoir 104 may include a shape such as, but not limited to, rectangular, ovular, circular, and the like. A top portion of reservoir 104 may include a porous surface, such as, but not limited to, a metal well grate. A metal well grate may include one or more metal bars that may be configured to keep objects above an interior portion of reservoir 104, such as leaves, rocks, trash, debris, and the like. A metal well grate may include a grid-like pattern of metallic rods. In some embodiments, reservoir 104 may include a bottom portion. A bottom portion of reservoir 104 may include a wall oriented horizontally and/or faced opposite a top portion of reservoir 104. Reservoir 104 may include a diameter of about 24 inches, less than 24 inches, or greater than 24 inches, without limitation.

While FIG. 1 depicts the reservoir 104 as being located outside land structure 128, in other embodiments the reservoir 104 can be located either on or within the land structure 128. In general, any known structure for the collection and/or storage of storm and/or waste water can qualify. For example, the reservoir 104 can be a collection/storage tank within or connect to the internal plumbing of a building, ducts, gutters and or other drainage systems located on the land structure 128, etc.

Still referring to FIG. 1, in some embodiments, reservoir 104 may be configured to receive storm and/or waste water 108. Storm and/or waste water 108 may include, but is not limited to, rain water, melted snow, runoff water, water generated from operation of the building, and/or other forms of water that may be captured by reservoir 104. In some embodiments, the system 100 is designed to handle a volume of water generated during, at a particular installation location, a 10 year storm, a 50 year storm, a 75 year storm, a 100 year storm, a 150 year storm, a 200 year storm, a 300 year storm, as those terms are understand by those skilled in the art. In some embodiments, storm and/or waste water 108 may include a mix of dirt, water, gravel, and/or other materials, without limitation. For instance, storm and/or waste water 108 may include a "slurry". A slurry may include a semiliquid mixture of particles of cement, manure, and/or coal suspended in water. Storm and/or waste water 108 may originate from one or more of street water, rain, melted snow, water generated from operation of the building, and/or other forms of liquids found in a local geography of reservoir 104. In various embodiments, the volume of storm and/or waste water that can be handled by system 100 at a single time includes at least 1 gallon, at least 100 gallons, at least 1,000 gallons, at least 10,000 gallons, and at least 100,000 gallons, at least 1,000,000 gallons, at least 10,000,000 gallons, at least 100,000,000 gallons. In some embodiments, the system 100 can include single conduit for delivering water to a subsurface region (sometimes referred to herein as a "well"). In other embodiments, the system 100 can be sized to include multiple wells, for example, at least 2 wells, at least 3 wells, at least 5 wells, at least 10 wells, at least 20 wells, at least 100 wells, at least 500 wells, and at least 1,000 wells. A "flow rate" as used in this disclosure is a volume of fluid that passes per unit of time. In some embodiments, reservoir 104 may receive storm and/or waste water 108 at a range of flow rates, e.g., at least 1 ounce per minute, at least 12 ounces per minute, at least 64 ounces per minute, at least 1 gallon per minute (gpm), at least 2 gpm, at least 4 gpm, at least 10 gpm, at least 100 gpm, at least 1,000 gpm.

Referring still to FIG. 1, system 100 may include conduit 112. A "conduit" as used in this disclosure is any object configured to direct a flow of fluid. Conduit 112 may include, but is not limited to, pipes, tubes, and/or other fluid conduits, including conduits not fully enclosed. Conduit 112 may include a material such as, without limitation, metal, plastic, and/or other materials. In general, conduit 112 can be oriented in any position and take any path desirable for directing fluid from the reservoir 104 to a subsurface region. Conduit 112 may be oriented in a substantially vertical position. In other embodiments, conduit 112 may include one or more curves, turns, and the like. For instance, conduit 112 may include a vertical line portion, a right-curved portion connected to the vertical line portion, and a second vertical line portion connected to the right-curved portion. Conduit 112 may include any combination of oriented sections, such as, but not limited to, horizontal sections, vertical sections, right-curved sections, left-curved sections, non-linear sections, and the like. In some embodiments, conduit 112 may include one or more sub-conduits. A "sub-conduit" as used in this disclosure is a portion of a conduit that branches out from a main portion of the conduit. For example, and without limitation, conduit 112 may include a horizontal line with four sub-conduits extending downwards into the ground from the horizontal line. Continuing this example, each sub-guiding member of the sub-conduits may be spaced equally apart from one another. Sub-conduits may include a diameter equal to, less than, or more than that of conduit 112. In some embodiments, sub-conduits of conduit 112 may each have a diameter and/or orientation differing from each other sub-guiding member of conduit 112. For instance, and without limitation, conduit 112 may include a horizontal line positioned at a ground surface level and may have a diameter of 10 inches. A first sub-guiding member may be connected to the horizontal line of conduit 112 and may be oriented in a vertical position, extending downwards in the ground from conduit 112. The first sub-guiding member may have a diameter of 6 inches. A second sub-guiding member may be connected to the horizontal line of conduit 112 and may be oriented in a diagonal position relative to the horizontal line of conduit 112 and may have a diameter of 4 inches. Sections of conduit 112 may be shaped to provide a pathway for storm and/or waste water 108 to one or more destinations, such as subsurface region 116. One of ordinary skill in the art, upon reading this disclosure, will appreciate the many various ways guiding members and sub-conduits may be positioned and/or oriented together.

Still referring to FIG. 1, conduit 112 may be in a fluidic communication with reservoir 104. A "fluidic communication" as used in this disclosure is a form of connection in which a mass of fluid travels between two or more objects. In some embodiments, conduit 112 may include a hollow interior, which may allow a passage of fluid. Conduit 112 may include a first end and a second end. A first end of conduit 112 may include an opening that may allow a passage of storm and/or waste water 108 through an interior of conduit 112 to a second end of conduit 112. A second end of conduit 112 may include an opening, which may allow a passage of storm and/or waste water 108 from an interior of conduit 112 to one or more underground regions, such as subsurface region 116. A "subsurface region" as used in this disclosure can be any space beneath a surface layer of ground. Subsurface region 116 may include, but is not limited to, layers of bedrock, layers of sand and gravel, layers of glacial till, and/or other ground layers, aquifers, bedrock, bedrock aquifers, fractures in earth by way of fracking, geological features (e.g., fractures, faults, cracks), abandoned deep mines, old gas fields, salt domes, etc. In some embodiments, subsurface region 116 may include an underground water reservoir and/or well. For instance, and without limitation, subsurface region 116 may be located beneath a first layer of the earth's surface layer. In some embodiments, a flow of storm and/or waste water 108 can travel from reservoir 104 through conduit 112 to an underground space may form subsurface region 116. For instance, and without limitation, subsurface region 116 may be empty before receiving storm and/or waste water 108 from conduit 112. In other embodiments, subsurface region 116 may have existing amounts of water, such as ground water, before receiving storm and/or waste water 108.

In general, any dimension of conduit 112 can have any suitable value as may be required for the transporting of volumes of fluid at the flow rates described herein. In various embodiments, the diameter of the conduit 112 can be in a range from 0-100 inches, 5-90 inches, inches, 15-70 inches, 20-65 inches, 25-60 inches, 30-55 inches, 35-50 inches, 40-45 inches, 0-10 inches, 10-20 inches, 20-30 inches, 30-40 inches, 40-50 inches, 50-60 inches, 60-70 inches, 70-80 inches, 80-90 inches, 90-100 inches, at least 4 inches, at least 6 inches, at least 8 inches, at least 10 inches, at least 12 inches, at least 24 inches, at least 36 inches, at least 48 inches, at least 60 inches, at least 72 inches, at least 84 inches, and at least 96 inches. In various embodiments, the thickness of the conduit 112 (e.g., thickness of a sidewall of the pipe) can be in a range from 0-12 inches, 2-10 inches, 3-8 inches, 4-6 inches, at least 1 inch, at least 2 inches, at least 3 inches, at least 4 inches, at least 5 inches, at least 6 inches, at least 7 inches, at least 8 inches, at least 9 inches, at least 10 inches, at least 11 inches, at least 12 inches.

In general, the conduit 112 can be formed of any suitable material may be required for the transporting of volumes of fluid at the flow rates described herein. In various embodiments, the conduit 112 can be formed from PVC plastic, steel, iron, aluminum, cement, reinforced concrete, and any other suitable material.

In FIG. 1, conduit 112 may penetrate one or more ground layers between reservoir 104 and subsurface region 116. In some embodiments, conduit 112 may penetrate three ground layers between subsurface region 116 and reservoir 104. Conduit 112 may be oriented in a straight vertical line from reservoir 104 to subsurface region 116. In other embodiments, conduit 112 may be curved, angled, and/or shaped another way, without limitation. Reservoir 104 may be positioned at land surface 120. A "land surface" as used in this disclosure is generally the top surface of the ground, exposed to open air onto which a building would be constructed. Land surface 120 may include a position on top of one or more ground layers. In some embodiments, land surface 120 include a top of a first ground layer, where land structure 128 and/or reservoir 104 may be positioned. Reservoir 104 may be positioned such that a top portion of reservoir 104 starts at land surface 120 and the rest of reservoir 104 may extend below land surface 120. Surrounding ground surface near a top of reservoir 104 may be shoveled, dug, and/or otherwise shaped to have an incline relative to a top portion of reservoir 104, allowing reservoir 104 to capture more water, increasing a volume of storm and/or waste water 108.

Referring again to FIG. 1, conduit 112 may penetrate a first layer of one or more ground layers, such as a groundwater layer. A "groundwater layer" as used in this disclosure is a level of the ground having a mass of water. Water located in a groundwater layer may include rainwater, runoff water, and/or other water types. Water in a groundwater layer may move throughout dirt, rock, and/or other materials at a rate of about 3 to about 25 inches per day. In some embodiments, a groundwater layer may extend between 1-50 feet below a top surface level, such as land surface 120. In other embodiments, a groundwater layer may extend past 50 feet below a top surface level. Conduit 112 may penetrate a second layer of one or more ground layers. A second layer may include, but is not limited to, a layer of sand and gravel. A layer of sand and gravel may be located between about 50 feet to about 150 feet below a top surface level. In other embodiments, a layer of sand and gravel may be located above 50 feet and/or below 150 feet below a top surface level. In some embodiments, conduit 112 may penetrate a third layer of one or more ground layers. A third layer may include a layer of glacial till. A layer of glacial till may be located between about 150 feet to 200 feet below a top surface level. In other embodiments, a layer of glacial till may be located above 150 feet and/or below 200 feet below a top surface level. A second end of conduit 112 may extend past one or more ground layers, such as the three ground layers described above, into a layer of bedrock. A layer of bedrock may be located about 200 feet below a top surface level. In other embodiments, a layer of bedrock may be located above and/or below 200 feet below a top surface level. In some embodiments, a second end of conduit 112 may be positioned at a second surface level (e.g., within the subsurface region). In some embodiments, a second surface level can include one or more ground layers about 200 feet below a top surface level. A second surface level may, in some embodiments, include one or more ground layers above and/or below 200 feet below a top surface level. Each ground layer may include a hydraulic conductivity. A 'hydraulic conductivity" as used in this disclosure is a property of porous materials that describes the ease with which a fluid can move through. In some embodiments, one or more ground layers may include a hydraulic conductivity of about $1.040\times10^{-3}$ cm/s. In other embodiments, one or more ground layers may have a higher or lower hydraulic conductivity than $1.040\times10^{-3}$ cm/s. For instance, a layer of sand and gravel may include a hydraulic conductivity of about 100 cm/s to about $10^{-5}$ cm/s. A layer of glacial tilt may include a hydraulic conductivity of about $10^{-3}$ cm/s to about $10^{-6}$ cm/s.

With continued reference to FIG. 1, reservoir 104 may be positioned directly below a building, such as land structure 128. A "land structure" as used in this disclosure is a construction positioned at or above a land surface. Land structure 128 may include, for example and without limitation, greenspaces, farming lands, parking lots, warehouses, manufacturing facilities, buildings, and the like. A building of land structure 128 may include, but is not limited to, government buildings, residential buildings, public buildings, and the like. Land structure 128 may include one or more tubes, such as, but not limited to, pipes, gutters, and the like, positioned at a top surface of land structure 128. For instance, land structure 128 may include one or more tubes, such as gutters, positioned at a roof level of land structure 128. One or more tubes of land surface 128 may provide a pathway for storm and/or waste water 108 from a top of land structure 128 to conduit 112. As a non-limiting example, land structure 128 may include a set of two gutters that extend from a roof of land structure 128 to reservoir 104 and/or conduit 112. One or more tubes of land structure 128 may extend past a width of land structure 128 in cases where reservoir 104 and/or conduit 112 is positioned further from the width of land structure 128. Land structure 128 may include a water table height at land surface of about 845 feet. In other embodiments, land structure 128 may include a water table height of greater than or less than 845 feet. Land surface may include a minimum grade elevation of about 850 feet. Reservoir 104 may be positioned on a left, right, front, and/or rear of land structure 128. In some embodiments, reservoir 104 may be positioned within a 50 foot radius of land structure 128. In other embodiments, reservoir 104 may be positioned in a radius greater than or less than 50 feet from land structure 128. In some embodiments, subsurface region 116 may be positioned beneath land structure 128. For instance, and without limitation, subsurface region 116 may be positioned at a second surface level and land structure 128 may be positioned at land surface. A distance between land surface and a second surface level, such as subsurface region 116, may include a range of about 200 feet, but is not limited to this range. In some embodiments, subsurface region 116 may be positioned directly underneath land structure 128. In other embodiments, subsurface region 116 may be positioned within a vicinity of land structure 128, such as, but not limited to, a radius of 5 feet or more from an edge of land structure 128. In some embodiments, reservoir 104 and/or subsurface region 116 may be positioned between multiple land structures 128. In some embodiments, two or more reservoirs 104 may be used within an area. For instance, and without limitation, about 30 to 35 reservoirs 104 may be positioned within a 50 acre site. Each reservoir 104 of the 30 to 35 reservoirs 104 may be positioned at least 100 feet away from each other, without limitation, to reduce well inefficiency.

With continued reference to FIG. 1, in some embodiments, system 100 may include a plurality of conduits 112. A plurality of conduits 112 may include two or more conduits 112. Each conduit 112 of a plurality of conduits 112 may extend from an area of land structure 128 to a central connector 132. A "central connector" as used in this disclosure is an object receiving two or more ends of a conduit. A plurality of conduits 112 may be positioned just below land surface 120, such as, but not limited to, a depth of 5 feet. In other embodiments, a plurality of conduits 112 may be positioned above or at land surface 120. A plurality of conduits 112 may be connected to a plurality of reservoirs 104. Each reservoir 104 may be positioned within a surrounding area or in an area of land structure 128. For instance, and without limitation, 12 reservoirs 104 may be positioned throughout a 20 acre area of land structure 128. The 12 reservoirs 104 may be positioned in a grid-like pattern, in a radial pattern, around a perimeter of land structure 128, and/or other positionings. Continuing this example, each reservoir of the 12 reservoirs 104 may each be connected to a conduit 112 of a plurality of conduits 112. Each conduit 112 may travel below or above land surface 120 to a central connector 132. A central connector may include a large disk-like structure that may have a plurality of receiving ends. A central connector 132 may combine storm and/or waste water 108 received from each conduit 112 of a plurality of conduits 112. In some embodiments, a central connector 132 may pass storm and/or waste water 108 to a water treatment component before the storm and/or waste water 108 travels to subsurface region 116. In other embodiments, a water treatment component may treat storm and/or waste water 108 after the storm and/or waste water 108 has reach subsurface region 116. A water treatment component may be described with further detail below with reference to FIG. 5.

Still referring to FIG. 1, in some embodiments, reservoir 104 may be positioned in a geography having a 100 year storm event of about 10 inches in 24 hours. A 100-year storm event refers to a rainfall total having a 1% probability of occurring at a specific location. For instance, reservoir 104 may be positioned in a geography having a 100 year storm event of 7.4 acres over a 24 hour period, such as in a town of Indiana. 7.4 acres in a 24 hour period may equate to about 1,675 gallons per minute of rainfall. Reservoir 104 may be positioned in other geographies having a higher or lower 100 year storm event rainfall estimate, without limitation.

In some embodiments, and continuing to refer to FIG. 1, subsurface region 116 and/or a surrounding of subsurface region 116, such as an aquifer, may be fracked and/or fractured. "Fracking" as used in this disclosure is a process of underground formation stimulation using a pressurized fluid. Fracking may involve fracking fluid, which may include water, sand, thickening agents, and the like. Fracking fluid may be pumped at a high pressure through a wellbore to create cracks in rock, allowing more flow of fluid. Ground layers at a second surface level may be fracked to increase well efficiency of subsurface region 116. For instance, and without limitation, water may be injected into a wellbore at a pressure of about 2,000 to 3,000 pounds per square inch (psi), which may cause targeted bedrock to fracture. In some embodiments, fracking may increase a size of existing fractures of formations at a second surface level. Fracking may also flush sediment and/or rock fragments in formations at a second surface level, such as subsurface region 116. In some instances, a fracking process may increase a yield of a water well, such as subsurface region 116, by about 1 gpm to about 10 gpm. In other embodiments, fracking may increase a yield of a water well by more than 10 gpm. A yield of a water well refers to a rate at which a well can be pumped while maintaining a health water level, measured in gallons per minute (gpm).

Figure 2:
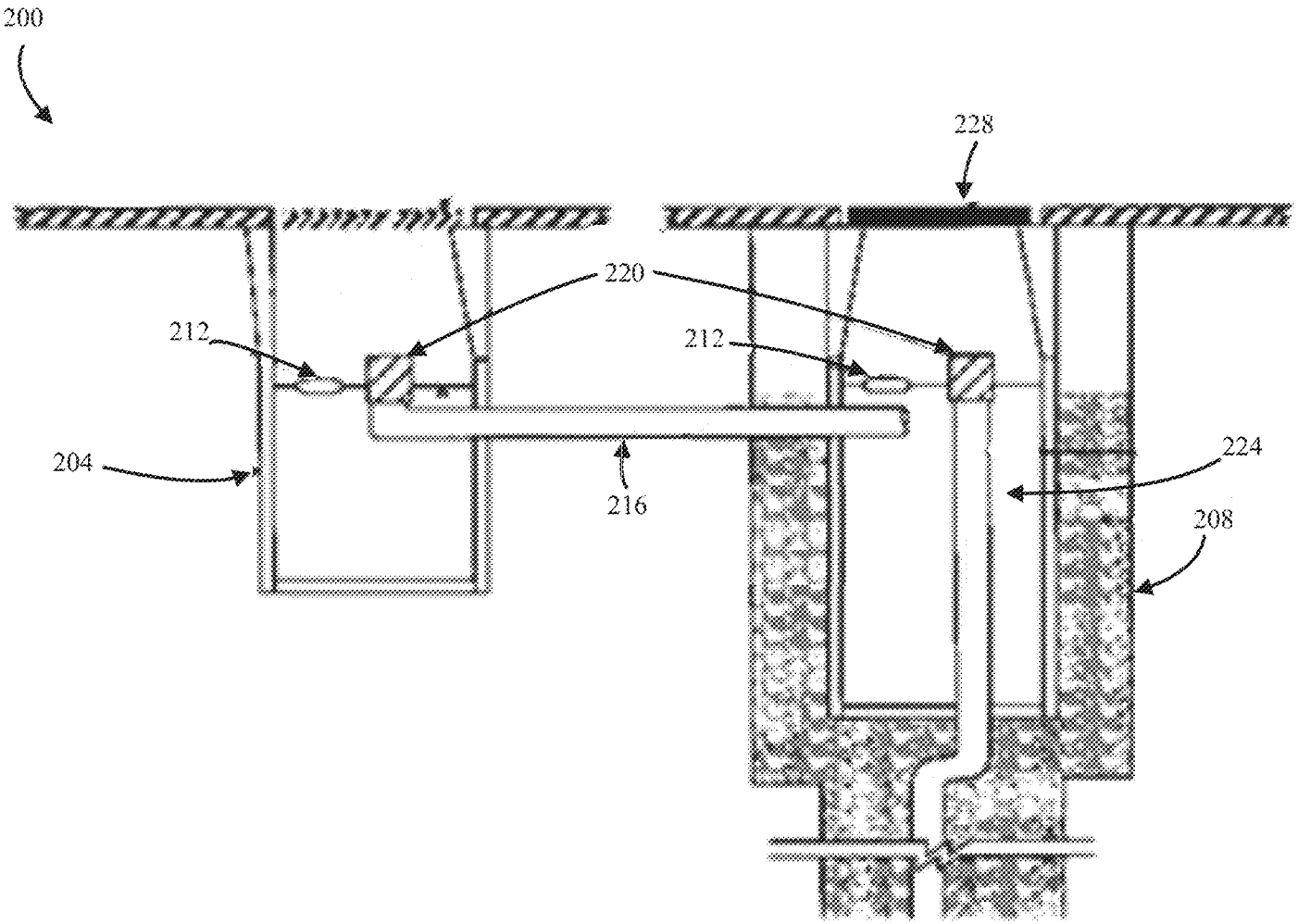
FIG. 2 is an image of a system for locating water beneath a land structure, according to various embodiments.

Referring now to FIG. 2, another embodiment of a system 200 for storing storm water is presented. System 200 may include reservoir 204 and well 208. Reservoir 204 may include a reservoir similar to that of reservoir 104 as described above with reference to FIG. 1, without limitation. Reservoir 204 may include a rectangular and/or square structure that may extend downwards from a surface level into one or more ground layers. Reservoir 204 may include dimensions such as, one or more heights, widths, lengths, volumes, and the like. In general, any suitable dimensions for the reservoir can be used. In various embodiments, any dimension of the reservoir can be in a range from 1-1,000 feet, 5-900 feet, 10-800 feet, 50-700 feet, 100-600 feet, 200-500 feet, 300-400 feet, 1-10 feet, 1-20 feet, 1-50 feet, 1-100 feet, e.g., 1 foot, 2 feet, 3 feet, 4 feet, 5 feet, 6 feet, 7 feet, 8 feet, 9 feet, or 10 feet. For instance, and without limitation, reservoir 204 may include a length of 3 feet and a depth of 6 feet. A length of reservoir 204 may be more than or less than 3 feet and a depth of reservoir 204 may be more than or less than 6 feet. Reservoir 204 may include one or more sides. In general the dimensions of the reservoir sides can have any suitable value. In various embodiments, the sides can have a width in a range from inches, 2-90 inches, 4-80 inches, 6-70 inches, 8-60 inches (e.g., 5-10 inches), 10-50 inches, 12-40 inches, 14-30 inches, 16-20 inches. In some embodiments, reservoir 204 may have two sides oriented in a vertical direction and faced opposite one another. For instance, reservoir 204 may have two horizontal sides spaced a predetermined distance apart. In general, the distance between the sides can have any suitable value, e.g., in a range from 0-100 feet, 2-90 feet, 4-80 feet, 6-70 feet, 8-60 feet, 10-50 feet, 12-40 feet, 14-30 feet, 16-20 feet, 1-10 feet, 1-20 feet, 1-50 feet, 1 foot, 2 feet, 3 feet, 4 feet, 5 feet, 6 feet, 7 feet, 8 feet, 9 feet, or 10 feet. Reservoir 204 may include a top portion positioned above two or more sides. A top portion of reservoir 204 may include a porous structure, such as, but not limited to, one or more meshes, grates, and the like. A top portion of reservoir 204 may include a metal well grate, as described above, without limitation. Reservoir 204 may include a material, such as, but not limited to, plastic, concrete, metal, and the like. Reservoir 204 may be configured to hold or otherwise retain fluids, such as storm and/or waste water 108 as described above with reference to FIG. 1, without limitation. In general, reservoir 204 may be configured to any suitable amount of fluid. In various embodiments, the reservoir 204 can hold up to 1 gallon of fluid, up to 5 gallons of fluid, up to 10 gallons of fluid, up to 20 gallons of fluid, up to 50 gallons of fluid, up to 100 gallons of fluid, up to 500 gallons of fluid, up to 1,000 gallons of fluid, up to 10,000 gallons of fluid, up to 100,000 gallons of fluid, up to 1,000,000 gallons of fluid.

Still referring to FIG. 2, reservoir 204 may include oil absorbent 212. Oil absorbent 212 may include one or more oil absorbing materials, such as, but not limited to, one or more polypropylene structures, natural fibers such as wood pulp, cotton, and flax fiber, and/or synthetic fibers such as acrylic, nylon, and/or polyester. Oil absorbent 212 may be placed reservoir 204 at a height of half of a total height of reservoir 204. In some embodiments, oil absorbent 212 may be placed higher than or lower than a height half of that of a total height of reservoir 204. Oil absorbent 212 may be in a form of a pad, block, or other rectangular structure, without limitation. In some embodiments, oil absorbent 212 may be positioned at a left, right, or other location within a chamber of reservoir 204. Oil absorbent 212 may be secured to one or more sides of reservoir 204, such as through one or more bolts, screws, and the like. In some embodiments, oil absorbent 212 may be movably positioned along a line of reservoir 204. For instance, a line, such as a plastic or other line, may be connected at a first end to a first side of reservoir 204 and a second end of the line may be connected to a second side of reservoir 204. In some embodiments, a line may be flexible. In other embodiments, a line of reservoir 204 may be rigid. Oil absorbent 212 may be configured to move along a line of reservoir 204. For instance, oil absorbent 212 may include a hollow middle section that may encompass a line. In other embodiments, oil absorbent 212 may include a securing mechanism such as a loop, latch, or other device, that may secure oil absorbent 212 to a line of reservoir 204. Oil absorbent 212 may be buoyant, which may allow oil absorbent 212 to rise and fall with water contained in a chamber of reservoir 204.

Still referring to FIG. 2, in some embodiments, reservoir 204 may include pipe 216. Pipe 216 may include, but is not limited to, a metal pipe, plastic pipe, and/or PVC pipe. Pipe 216 may provide a fluidic communication between reservoir 204 and well 208. Pipe 216 may start in in reservoir 204, extend outside of reservoir 204 into a ground layer, and enter a well 208. An end of pipe 216 of reservoir 204 may include debris shield 220. A "debris shield" as used in this disclosure is an object and/or mechanism that prevents certain materials from passing through a passage. Debris shield 220 may include one or more filtering elements, such as, but not limited to, metal rods, grates, and/or other elements. Pipe 216 may include one or more debris shields 220, such as, but not limited to, at one or more ends of pipe 216. For instance, an end of pipe 216 in reservoir 204 may include debris shield 220 positioned at a top portion of the end of pipe 216. An end of pipe 216 may include a curved section. For instance, a curved section of pipe 216 may be aimed upwards. A top of a curved section of pipe 216 may be positioned within the chamber of reservoir 204. In general, the pipe 216 can be positioned at any suitable location. In various embodiments, the pipe 216 can be positioned at ⅛ the height of the reservoir 204, ¼ the height of the reservoir 204, ⅜ the height of the reservoir, half the height of the reservoir 204, ¾ the height of the reservoir, ⅞ the height of the reservoir, in a range from 0-1, in a range from 0-2 feet above a bottom portion of reservoir 204 feet above a bottom portion of reservoir 204, in a range from 0-4 feet above a bottom portion of reservoir 204, in a range from 0-10 feet above a bottom portion of reservoir 204, in a range from 0-50 feet above a bottom portion of reservoir 204, in a range from 0-100 feet above a bottom portion of reservoir 204. Pipe 216 may be positioned at a specific length of reservoir 204, such as, but not limited to, 2 feet from a left side of reservoir 204.

While still referring to FIG. 2, pipe 216 may enter well 208. Well 208 may include a rectangular, square, and/or other shaped structure. In some embodiments, well 208 may include a material such as, but not limited to, concrete, metal, plastic, and the like. Well 208 may include one or more sides, a top portion, and/or a bottom portion similar to that of reservoir 204 as described above. Well 208 may include a depth greater than that of reservoir 204. For instance, well 208 may include a depth of about 8 feet, without limitation. In some embodiments, well 208 may include a length of 8 feet, a width of 5 feet, and a height of 4 feet, having a volume of 160 cubic feet. A top portion of well 208 may include cover 228. Cover 228 may include a removable cover, such as, but not limited to, a manhole cover. Cover 228 may include one or more openings that may allow fluids such as gases, liquids, and the like, to exit well 208. For instance, in a case of overflow of well 208, water may exit through one or more openings of cover 228.

With continued reference to FIG. 2, in some embodiments, well 208 may include drainage pipe. Draining pipe 224 may include a pipe similar to that of pipe 216. Drainage pipe 224 may include a top end positioned at a height within well 208. Well 208 and/or drainage pipe 224 may include oil absorbent 212 and/or debris shield 220 similar to that of reservoir 204, as described above, without limitation. Drainage pipe 224 may include a first section in a substantially vertical orientation. For instance, drainage pipe 224 may include a first end at a height of well 208 and a second end linearly connected to the first end, the second end extending downwards into the ground. Drainage pipe 224 may extend through a bottom portion of well 208. In some embodiments, drainage pipe 224 may include an "S", "L", or other shaped portion connected to the linear portion described above. A shaped portion of drainage pipe 224 may curve through the ground to avoid certain geology, such as rocks, layers of ground, and the like. A second end of pipe 224 may extend towards an external body of water located below reservoir 204 and/or well 208, such as the subsurface region 116 as descried above with reference to FIG. 1, without limitation. An end of pipe 224 may extend downwards towards a void of bedrock or similar ground materials.

Figure 3:
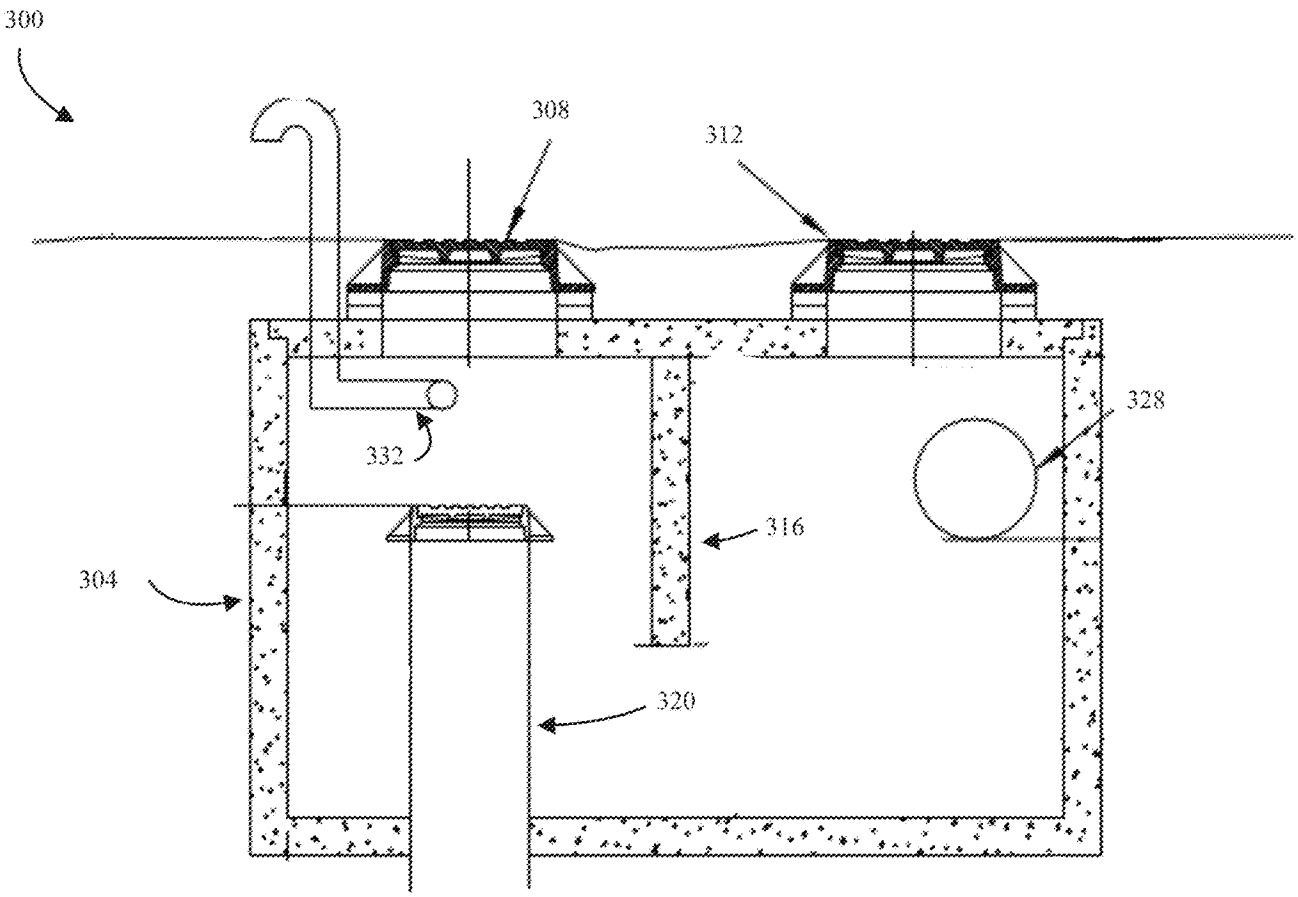
FIG. 3 is an image of another system for locating water beneath a land structure, according to various embodiments.

Referring now to FIG. 3, a side view of a system 300 for fluid storage is shown. System 300 may include reservoir 304. Reservoir 304 may include reservoir 104 as described above with reference to FIG. 1. In some embodiments, reservoir 304 may include one or more sides. Each side of reservoir 304 may be made of a material such as, but not limited to, concrete, metal, plastic, and/or any combination thereof, without limitation. In some embodiments, each wall of reservoir 304 may include a width. Widths of sides of reservoir 304 may include a range of about 1 inches to 10 inches. In some embodiments, each side of reservoir 304 may have a width of about 8 inches. A total length of reservoir 304 may a range of about 8 feet to about 10 feet, without limitation. An interior of reservoir 304 may include a length of about 7 feet to about 8 feet, without limitation. A height of an interior of reservoir 304 may include a range of about 5 feet to about 10 feet, without limitation. In some embodiments, reservoir 304 may have a specific capacity of about 300 gpm per foot. A "specific capacity" as used in this disclosure is a rate of discharge per unit drawdown. A specific capacity may indicate an effectiveness of a well. Reservoir 304 may be positioned in a certain geography, such as Florida, Wisconsin, Indiana, and the like.

Still referring to FIG. 3, system 300 may include first drain 308 and/or second drain 312. First drain 308 and/or second drain 312 may be positioned below a finished grade surface level at a range of about 1 foot to about 9 feet below the finished grade surface level. In an embodiment, first drain 308 and/or second drain 312 may be positioned 1 ft 9 in below a finished grade surface level. First drain 308 and/or second drain 312 may include a porous top surface, such as, but not limited to, one or more metal pipes, grid-like materials, and the like. In one embodiment, first drain 308 and/or second drain 312 may include, as one illustrative example, U.S. Foundry Model No. 195-E-BTWL storm sewer drains. First drain 308 and/or second drain 312 may be porous, allowing liquids such as rainwater, water runoff, and/or other fluids, to enter reservoir 304 through an opening of a bottom portion of each of first drain 308 and second drain 312. In some embodiments, first drain 308 may be separated from second drain 312 through inner wall 316. Inner wall 316 may include a baffle wall. Inner wall 316 may include a width of about 6 inches, greater than 6 inches, or less than 6 inches. Inner wall 316 may extend downwards from a middle portion of a top wall of reservoir 304. Inner wall 316 may have a length of about 3.5 feet, greater than 3.5 feet, or less than 3.5 feet, without limitation. Inner wall 316 may separate water from a right side of reservoir 304 with respect to a left side of reservoir 304.

With continued reference to FIG. 3, reservoir 304 may include pipe 320. Pipe 320 may be configured to direct water stored in reservoir 304 to an external body of water. Pipe 320 may be positioned directly underneath first drain 308. Pipe 320 may be positioned 2 feet below drain 308. In some embodiments, pipe 320 may be positioned greater than or less than 2 feet below drain 308. Pipe 320 may be positioned 1 foot from a left side of reservoir 304. In other embodiments, pipe 320 may be positioned greater than or less than 1 foot from a left side of reservoir 304. Pipe 320 may extend through a bottom side of reservoir 304 to a distance of 3.5 feet above a bottom side of reservoir 304, without limitation. Pipe 320 may extend greater than or less than 3.5 feet above a bottom side of reservoir 304. Pipe 320 may be positioned about 1 foot away from a left side of a bottom end of inner wall 316, but is not limited to such positioning. In some embodiments, pipe 320 may have one or more openings at a top end of pipe 320. Openings of pipe 320 may have a diameter of about 1.5 inches. In some embodiments, openings of pipe 320 may have a diameter greater than or less than 1.5 inches. Openings of pipe 320 may allow a passage of fluid from reservoir 304 through a body of pipe 320, which may extend outside reservoir 304 and into an external body of water. Pipe 320 may have a total opening area of about 1 to 2 square feet. In some embodiments, pipe 320 may include a total opening area of 1.7 square feet. Pipe 320 may have a total opening area of greater than or less than 1.7 square feet. In some embodiments, pipe 320 may include a heavy duty bee hive grate.

In FIG. 3, system 300 may include fluid connector 324. Fluid connector 324 may include a circular hole or other opening that may provide a path for water of reservoir 304 to exit reservoir 304. For instance, and without limitation, fluid connector 324 may include a tube and/or pipe that may lead from reservoir 304 to an outside of reservoir 304. Fluid connector 324 may be positioned 3.5 feet above a bottom side of reservoir 304, without limitation. In some embodiments, fluid connector 324 may be positioned higher or lower than 3.5 feet above a bottom side of reservoir 304. Fluid connector 324 may include a pre-treated storm drain connection.

Continuing to refer to FIG. 3, system 300 may include vent pipe 328. Vent pipe 328 may include a tubular structure with a first end inside reservoir 304 and a second end outside reservoir 304. A second end of vent pipe 328 may be curved, rectangular, and the like. Vent pipe 328 may carry water and/or gas from reservoir 304 to an outside environment of reservoir 304, without limitation. A second end of vent pipe 328 may be positioned at about 6 inches from a finished grade. In other embodiments, vent pipe 328 may be positioned greater than or less than 6 inches from a finished grade.

Figure 4:
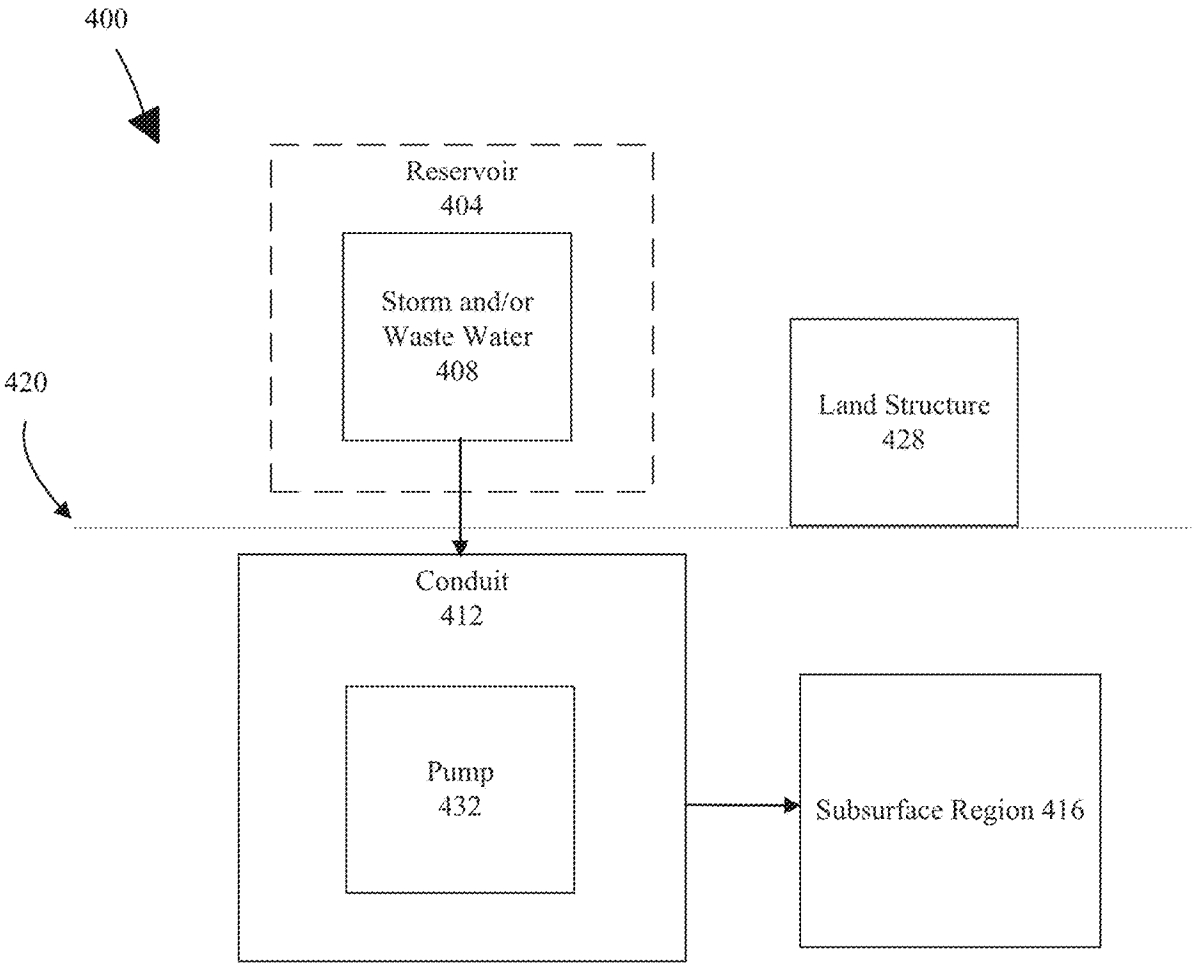
FIG. 4 is a block diagram of another system for locating water with a pump, according to various embodiments.

Referring now to FIG. 4, an embodiment of a system 400 for storing fluid with a pump is illustrated. System 400 may include reservoir 404, storm and/or waste water 408, conduit 412, subsurface region 416, land surface 420, and/or land structure 428, each of which may be as described or similar to that of FIG. 1. In some embodiments, conduit 412 may include pump 432. A "pump" as used in this disclosure is a mechanical device that applies force to a fluid. Pump 432 may include, but is not limited to, positive displacement pumps, rotary displacement pumps, dynamic pumps, centrifugal pumps, axial and radial centrifugal pumps, reciprocating pumps, submersible pumps, peristaltic pumps, diaphragm pumps, and/or other types of pumps. Pump 432 may be configured to increase a flow of storm and/or waste water 408 to external body of water 416. For instance, pump 432 may increase a flow rate of storm and/or waste water 408 to about 10 gallons per minute (gpm). In other embodiments, pump 432 may increase a flow rate of storm and/or waste water 408 to greater than or less than 10 gpm. Pump 432 may be positioned inside reservoir 404, such as at a bottom of reservoir 404. In some embodiments, pump 432 may be positioned at a top end of conduit 412. Pump 432 may pump storm and/or waste water 408 through a top end of conduit 412. Pump 432 may include one or more tubes and/or pipes that may fluidically connect with conduit 412. In some embodiments, pump 432 may be switchable between an active state and an inactive state. An active state may include pumping water to conduit 412. An inactive state may include ceasing pumping operations. In some embodiments, pump 432 may include one or more communication devices, such as, but not limited to, Bluetooth modules, Wi-Fi modules, and the like, which may allow a user to remotely switch pump 432 between active and inactive states. In some embodiments, pump 432 may have a sensing mechanism, such as, but not limited to, potentiometric pressure sensors, inductive pressure sensors, capacitive pressure sensors, piezoelectric pressure sensors, strain gauge pressure sensors, variable reluctance pressure sensors, and the like. A sensing mechanism of pump 432 may be configured to detect changes in volumes of water, water pressures, water flow rates, and the like. Pump 432 may include a microcontroller and/or other processing unit that may communicate with a sensing mechanism. A microcontroller or other processing unit of pump 432 may be configured to receive pump data from a sensing mechanism of pump 432 and control an operation of pump 432 based on the pump data. "Pump data" as used in this disclosure is information relating to a pumping device. Pump data may include, but is not limited to, voltage, current, temperatures, flow rates, water pressures, and the like. As a non-limiting example, pump 432 may determine, through a sensing mechanism and/or microcontroller, that a water level of reservoir 404 is exceeding a threshold of 3 feet in height. Pump 432 may increase a pump rate which may increase a flow rate of storm and/or waste 408 based on the sensed exceeded threshold of 3 feet.

As discussed above, one reason a skilled person may be demotivated to locate storm and/or waste water into certain subsurface regions is that such regions can be difficult to access (e.g., bedrock, bedrock aquifers, etc.). Another reason why underground storage may be undesirable is the limited storage capacity in certain underground regions that may be thought not large enough to contain the amounts of fluid required for storm and/or waste water. For example, chambers formed in hard regions of bedrock may be of limited capacity, incapable of storing an amount of water generated during a 100 year storm, for example. Furthermore, storage of water underground may also be considered undesirable if there is a desire to reuse the water for some above-ground purpose. Applicant appreciated these difficulties and developed a solution including use of a fluid retrieval system, in various embodiments, as described below.

Figure 5:
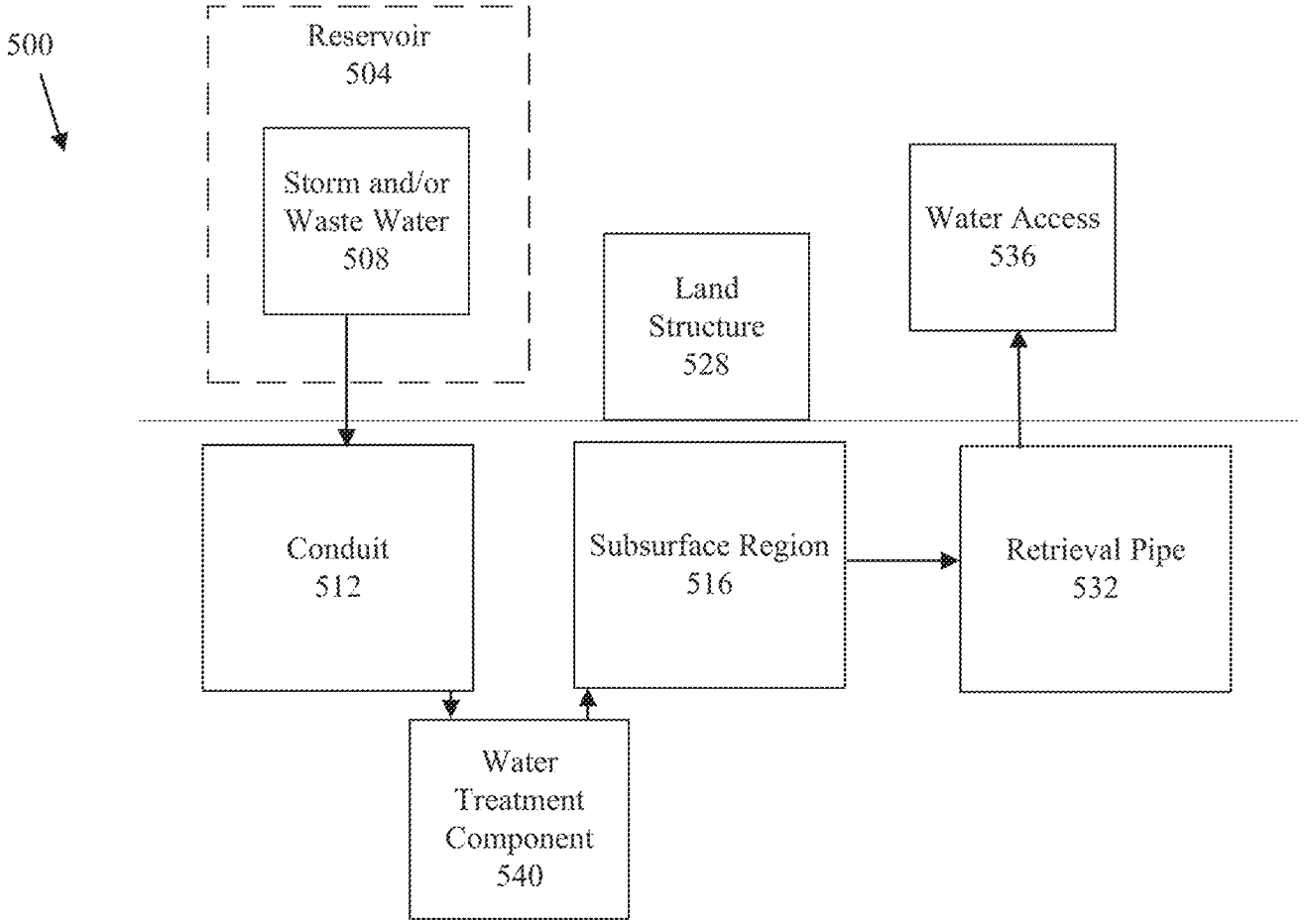
FIG. 5 is a block diagram of a water retrieval system, according to various embodiments.

Referring now to FIG. 5, a system 500 for fluid retrieval is presented. System 500 may include reservoir 504, storm and/or waste water 508, conduit 512, subsurface region 516, land surface 520, and land structure 528, which may be similar to the elements as described above with reference to FIG. 1. System 500 may include fluid conduit 532. A "fluid conduit" as used in this disclosure is a tube and/or other pipe-like structure that guides fluid from a storage space to an access space. Fluid conduit 532 may include a well structure or other water retaining mechanism. A storage space may include a body of water, such as subsurface region 516. An access space may include an above-ground water pool, spout, pump, and the like. Subsurface region 516 may be underground, positioned at second level 524. Fluid conduit 532 may be in fluidic communication with external body of water 516 and an access space, such as water access 536. Water access 536 may include, but is not limited to, a well, fluid retainer, pool of water, and the like. Water access 536 may be positioned above-ground, such as at land surface 520. In some embodiments, fluid conduit 532 may bring water from subsurface region 516 to water access 536. Fluid conduit 532 may include one or more pumps and/or other fluid moving mechanisms that may deliver water from subsurface region 516 to water access 536. For instance, and without limitation, fluid conduit 532 may include a submersible pump that may be configured to deliver a flow rate of about 15 gpm to about 20 gpm. In some embodiments, two or more fluid conduits 532 may be positioned near subsurface region 516. A first fluid conduit 532 may be positioned on a left side of subsurface region 516 and a second fluid conduit 532 may be positioned on a right side of subsurface region 516. A separation of a first fluid conduit 532 and a second fluid conduit 532 may help prevent hydraulic interference. Fluid conduit 532 may include a casing and/or screen that may prevent debris and/or other materials from passing through fluid conduit 532. A casing and/or screen of fluid conduit 532 may include a diameter of about 3 inches to about 4 inches, less than 3 inches, or greater than 4 inches. An individual may retrieve water from subsurface region 516 through water access 536.

Still referring to FIG. 5, in some embodiments, system 500 may include water treatment component 540. A "water treatment component" as used in this disclosure is a mechanism, device, and/or object that decontaminates water. Water treatment component 540 may be positioned above subsurface region 516, such as at or just below a land surface level. As a non-limiting example, storm and/or waste water 508 may travel through conduit 512 into water treatment component 540. Water treatment component 540 may decontaminate storm and/or waste water 508 and forward storm and/or waste water 508 to subsurface region 516. In other embodiments, water treatment component 540 may be positioned at or below a positioning of subsurface region 516. For instance, and without limitation, conduit 512 may direct storm and/or waste water 508 to subsurface region 516. Water treatment component 540 may pump or otherwise extract storm and/or waste water 508 from subsurface region 516 and treat the storm and/or waste water 508. Water treatment component 540 may communicate treated storm and/or waste water 508 to fluid conduit 532. Water treatment component 540 may include, but is not limited to, chemical, physical, and/or other decontamination mechanisms. Water treatment component 540 may be configured to perform one or more water treatment procedures. Water treatment component 540 may perform a coagulation step on storm and/or waste water 508. A coagulation step may include adding one or more chemicals with a positive charge to storm and/or waste water 508 which may neutralize one or more negative charges of dirt and/or other dissolved particles of storm and/or waste water 508. Water treatment component 540 may be configured to perform a flocculation procedure. A flocculation produce may include gentle mixing storm and/or waste water 508, such as through paddles and/or other mixing mechanisms. Water treatment component 540 may perform a flocculation procedure to form flocs of storm and/or waste water 508. In some embodiments, water treatment component 540 may facilitate a sedimentation process. A sedimentation process may include separating solids from storm and/or waste water 508. This may occur, without limitation, through the coagulation and/or flocculation steps as described above. Water treatment component 540 may perform a filtration step. For instance, water treatment component 540 may include a microfiltration system which may include filtering water from through a filter having a pore size of about 0.1 microns. In other embodiments, water treatment component 540 may include a reverse osmosis, distillation, and/or other purification system. Water treatment component 540 may include, for example, and without limitation, an Aqua-Swirl®, Aqu-Filter®, and/or other products. Water treatment component 540 may be in fluidic communication with external body of water 516 and fluid conduit 532. Water treatment component 540 may include one or more pipes, tubes, basins, and the like, that may connect water treatment component 540 to subsurface region 516 and/or retrieval pipe 532. Fluid conduit 532 may bring treated water from water treatment component 540 to water access 536.

Figure 6:
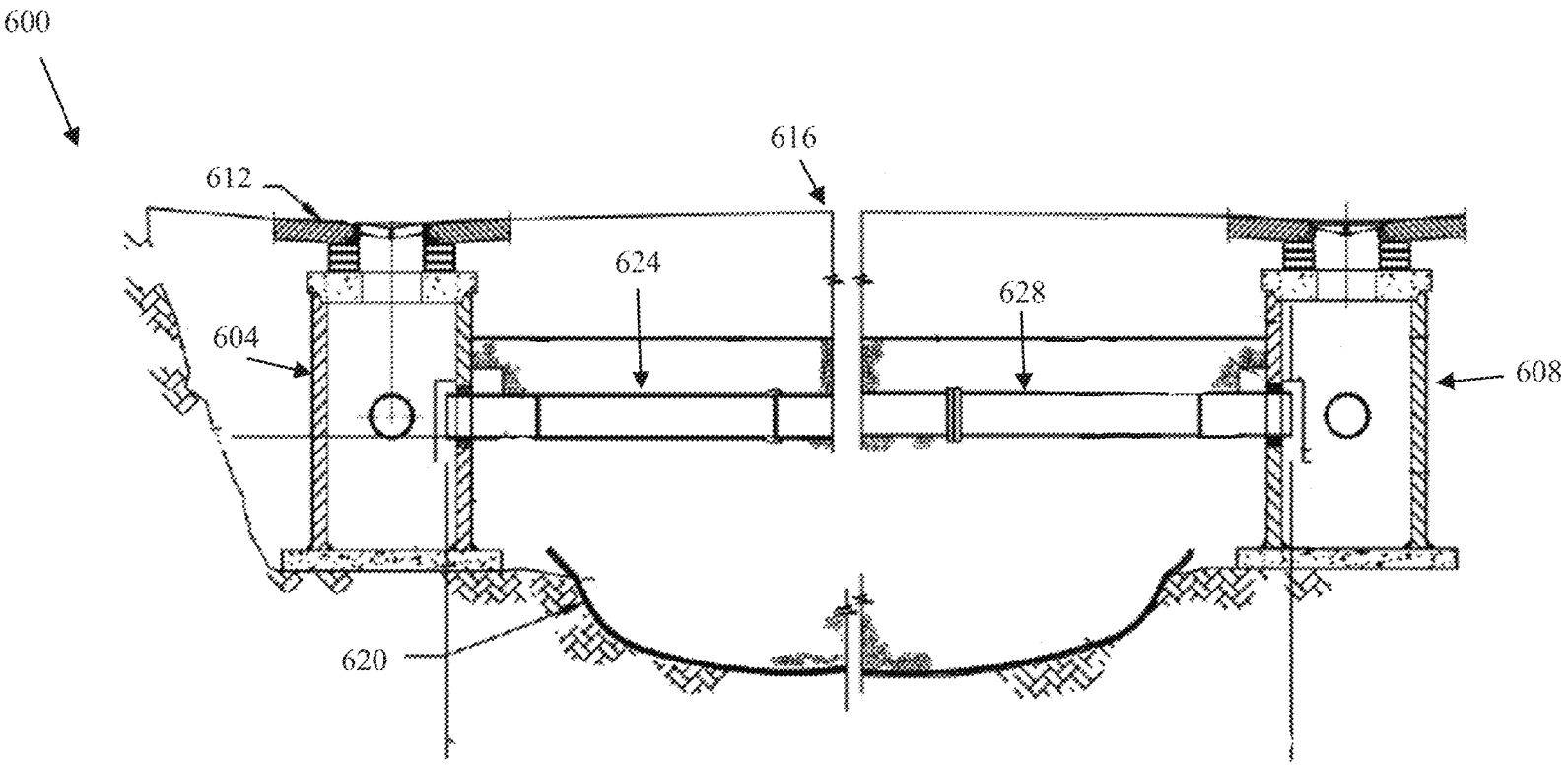
FIG. 6 is an image of an alternate system for locating water using trenches, according to various embodiments.

Referring now to FIG. 6, an embodiment of a system for storing storm and/or waste water using trenches is illustrated. System 600 may include first storage device 604 and/or second storage device 608. First storage device 604 and/or second storage device 608 may include a rectangular, square, and/or other shaped structure. In some embodiments, each of first storage device 604 and/or second storage device 608 may be configured to retain an amount of water, such as storm and/or waste water 108 as described above with reference to FIG. 1, without limitation. First storage device 604 and/or second storage device 608 may be configured to hold up to 50 gallons of water. In other embodiments, first storage device 604 and/or second storage device 608 may be configured to hold less than or greater than 50 gallons of water.

Still referring to FIG. 6, first storage device 604 and/or second storage device 608 may be positioned below land surface 612. Land surface 612 may include a top level of ground, such as, but not limited to, asphalt surfaces, grass and dirt surfaces, and/or other surfaces. First storage device 604 and second storage device 608 may be separated by trench 616. Trench 616 may include a hole or other space between two or more surface and/or ground layers. Trench 616 may be an opening of a top surface to a subsurface region, such as subsurface region 620. In some embodiments, trench 616 may have an opening width of about 4 feet. In other embodiments, trench 616 may have an opening width of greater than or less than 4 feet. In some embodiments, trench 616 may have a width of about 11.5 feet. Trench 616 may include a depth of about 1 foot to about 2 feet. In other embodiments, trench 616 may include a depth less than 1 foot or greater than 2 feet. In some embodiments, trench 616 may include a depth of about 6 feet. Trench 616 may include a wire elevation. A wire elevation may include a height from a bottom of a channel to a top of a trench, such as trench 616. In some embodiments, trench 616 may include a wire elevation of about 848 feet. In other embodiments, trench 616 may include a wire elevation of greater than or less than about 848 feet. Trench 616 may include one or more filters placed within one or more portions of trench 616. For instance, trench 616 may include a plastic filter fabric placed on all sides, the top of, and the bottom of trench 616. A plastic filter fabric may filter debris and/or other materials away from first pipe 624 and/or second pipe 628.

While still referring to FIG. 6, trench 616 may provide passage to subsurface region 620. Subsurface region 620 may include subsurface region 116 as described above with reference to FIG. 1. In some embodiments, subsurface region 620 may include one or more voids of one or more ground layers beneath trench 616. For instance, and without limitation, subsurface region 620 may include a void in a layer of bedrock. Subsurface region 620 may be able to hold up to 50 gallons of water. In other embodiments, subsurface region 620 may hold less than or greater than 50 gallons of water. Trench 616 may provide a passage for rainwater, stormwater, and/or wastewater to enter subsurface region 620. Trench 616 and/or subsurface region 620 may have a exfiltration capacity of about 6 gallons per minute per foot of head. In other embodiments, trench 616 and/or subsurface region 620 may have an exfiltration capacity of greater than or less than 6 gallons per minute per foot of head.

While still referring to FIG. 6, system 600 may include first pipe 624 and/or second pipe 628. First pipe 624 may include a metallic, plastic, and/or other type of material, without limitation. In some embodiments, first pipe 624 may include a PVC pipe. In general, any dimension of the pipes 624, 628 can have any suitable value. In various embodiments, the diameter of the pipe can be in a range from 0-100 inches, 5-90 inches, 10-80 inches, 15-70 inches, 20-65 inches, 25-60 inches, 30-55 inches, 35-50 inches, 40-45 inches, 0-10 inches, 10-20 inches, 20-30 inches, 30-40 inches, 40-50 inches, 50-60 inches, 60-70 inches, 70-80 inches, 80-90 inches, 90-100 inches, at least 4 inches, at least 6 inches, at least 8 inches, at least 10 inches, at least 12 inches, at least 24 inches, at least 36 inches, at least 48 inches, at least 60 inches, at least 72 inches, at least 84 inches, and at least 96 inches. In various embodiments, the thickness of the pipes (e.g., thickness of a sidewall of the pipe) can be in a range from 0-12 inches, 2-10 inches, 3-8 inches, 4-6 inches, at least 1 inch, at least 2 inches, at least 3 inches, at least 4 inches, at least 5 inches, at least 6 inches, at least 7 inches, at least 8 inches, at least 9 inches, at least 10 inches, at least 11 inches, at least 12 inches. In various embodiments, the length of the pipes can be in a range from 0-50 feet, 5-45 feet, 10-40 feet, 15-35 feet, 20-30 feet, at least 1 foot, at least 2 feet, at least 3 feet, at least 4 feet, at least 5 feet, at least 6 feet, at least 7 feet, at least 8 feet, at least 9 feet, at least 10 feet. First pipe 624 may include a diameter of 10 inches, a thickness of 1.5 inches, and a length of 5 feet, without limitation. In some embodiments, first pipe 624 may include a diameter of 15 inches. First pipe 624 may be uniformly shaped, such as in a shape of a rod or other cylindrical element. First pipe 624 may include a first end that may be in fluidic communication with first storage device 604. A first end of first pipe 624 may be positioned at a specific height of first storage device 604, for instance, and without limitation, half a total height of first storage device 604. A first end of first pipe 624 may include one or more sealing mechanisms that may prevent one or more fluids from exiting a side of first storage device 604. For instance, a first end of first pipe 624 may include a grout coating. First pipe 624 may include a second end. A second end of first pipe 624 may extend in a linear fashion from a first end of first pipe 624 and into a side of trench 616. A second end of first pipe 624 may include an opening, such as, but not limited to, a circular, rectangular, square, and/or other opening. A second end of first pipe 624 may provide a passage for fluids, such as stormwater, rainwater, and/or wastewater, to enter first storage device 604. A second end of first pipe 624 may be positioned at a specific height that may correspond to a water level of subsurface region 620. For instance, and without limitation, a second end of first pipe 624 may be positioned 6 feet above subsurface region 620. Water may flow through an opening of trench 616 and fill a volume of subsurface region 620. In some instances, a water level of subsurface region 620 may raise to a second end of first pipe 624. First pipe 624 may drain subsurface region 620 through providing a passage of water to first storage device 604.

With continued reference to FIG. 6, second pipe 628 may be similar to that of first pipe 624. Second pipe 628 may include a tubular or otherwise cylindrical structure. Second pipe 628 may include a material such as, but not limited to, metal, plastic, and the like. In some embodiments, second pipe 628 may include a PVC pipe. Second pipe 628 may have a diameter of about 15 inches, less than 15 inches, or greater than 15 inches. Second pipe 628 may be positioned within a portion of trench 616. For instance, second pipe 628 may be encased in a ground layer of trench 616. In some embodiments, second pipe 628 may be positioned below a surface level, such as at a depth of 2 feet, without limitation. Second pipe 628 may include a first end and a second end. A first end of second pipe 628 may face a second end of first pipe 624. A first end of second pipe 628 may face towards trench 616 and/or subsurface region 620. A first end of second pipe 628 may be connected to a second end of second pipe 628. A second end of second pipe 628 may be positioned within a side of second storage device 608. A second end of second pipe 628 may be positioned at a specific height of a side of second storage device 608. For instance, and without limitation, a second end of second pipe 628 may be positioned at a height half that of a total height of second storage device 608. A second end of second pipe 628 may be secured to a side of second storage device 608. For instance, and without limitation, a grout coating. Second pipe 628 may provide a passage for stormwater, rainwater, and/or wastewater to flow from a first end of second pipe 628 to second storage device 608 through a second end of second pipe 628. Second pipe 628 may be positioned such that second pipe 628 mirrors that of first pipe 624. A second end of first pipe 624 and a first end of second pipe 628 may be spaced apart by 5 or more inches. In other embodiments, a first end of second pipe 628 and a second end of first pipe 624 may be positioned closer less than or greater than 5 inches apart.

Still referring to FIG. 6, trench 616 may allow a passage of water to fall into subsurface region 620. Subsurface region 620 may fill with water passed from trench 616. First pipe 624 and/or second pipe 628 may drain water from subsurface region 620 into first storage device 604 and/or second storage device 608. Subsurface region 620 may have a hydraulic conductivity value of about $1.04\times10^{-3}$ m/s. In other embodiments, subsurface region 620 may have a hydraulic conductivity value of greater than or less than $1.04\times10^{-3}$ m/s. Subsurface region 620 may have a height relative to a mean high water table elevation of a surrounding geology of subsurface region 620. For instance, subsurface region 620 may have a height of 2 or more feet above the top of a mean high water table elevation. In other embodiments, subsurface region 620 may have a height greater than or less than 2 or more feet above a top of a mean high water table elevation. In an embodiment, subsurface region 620 may have a height of about 5 feet above a top of a mean high water table elevation. A mean high water table elevation of subsurface region 620 may be about 845 feet. In other embodiments, a mean high water table elevation of subsurface region 620 may be less than or greater than about 845 feet. Trench 616 and/or subsurface region 620 may be configured to store water from a site having an acreage of about 1 acres to about 100 acres. In other embodiments, trench 616 and/or subsurface region 620 may be configured to store water from a site having an acreage of less than 1 acres or greater than 100 acres. In an embodiment, trench 616 and/or subsurface region 620 may be configured to store water at a site having an acreage of about 49.58 acres. A surrounding location of trench 616 and/or subsurface region 620 may include a building occupying 40% of a total acreage of a site of the surrounding location. For example, a surrounding site of trench 616 and/or subsurface region 620 may have an acreage of 49.58. One or more buildings may occupy 40% of the 49.58 acres, which may be equal to a total of 19.832 acres. A surrounding location of trench 616 and/or subsurface region 620 may include a pervious and/or impervious mass of land. "Pervious" may refer to a percolation of water into underlying soil of a land mass. For instance, a surrounding location of trench 616 and/or subsurface region 620 may include a percent of acreage that may be pervious and/or impervious to water penetration. In some embodiments, a surrounding location of trench 616 and/or subsurface 620 may include an acreage of 49.58 acres, 25% of which may be pervious (12.395 acres), 35% of which may be impervious (17.35 acres), 40% of which may be occupied by one or more buildings (19.832 acres), and a total impervious land mass at 75% the acreage (37.19 acres). In some embodiments, a pervious amount of land mass may be greater than or less than 25% of a total acreage and an impervious amount of land mass may be greater than or less than 35% of a total acreage, without limitation.

Figure 7:
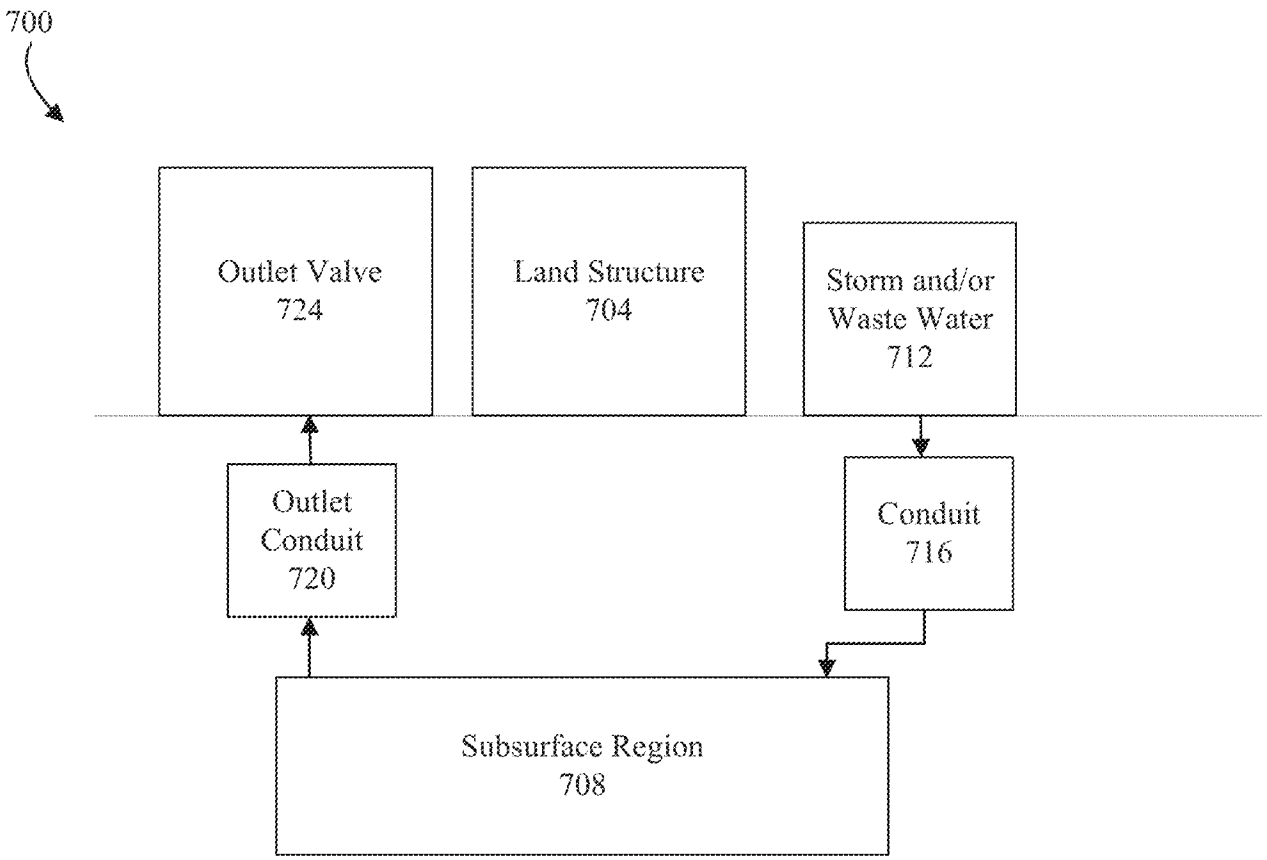
FIG. 7 is a block diagram of another embodiment of a system for locating water.

FIG. 7 illustrates another embodiment of a system 700 for locating storm and/or waste water. System 700 may include land structure 704, conduit 716, storm and/or waste water 712, and subsurface region 708, all of which may be similar to that as described above with reference to FIGS. 1 and FIGS. 4-5. System 700 may include outlet valve 724. Outlet valve 724 may include a fluid conduit that provides access to water from subsurface region 708. In some embodiments, storm and/or waste water 712 may be directed to subsurface region 708. Conduit 716 may include one or more sub-conduits, such as, but not limited to, four sub-conduits arranged in a horizontal row. Each sub-conduit of the four sub-conduits may extend into subsurface region 708 through one or more ground layers below land structure 704. Outlet valve 724 may receive water stored in subsurface region 708 through outlet conduit 720. Outlet conduit 720 may include a pipe, tube, or other structure that may provide fluidic communication between outlet valve 724 and subsurface region 708. In some embodiments, outlet conduit 720 may include one or more pumps. Outlet valve 724 may provide individual's access to water from subsurface region 708 at a flow rate of about 10 gpm, greater than 10 gpm, or less than 10 gpm, without limitation.

FIG. 8 is a chart including example parameters related to the fluid transport system 100 described herein. Each numerical value presented herein is contemplated to represent a minimum value or a maximum value in a range for a corresponding parameter. Accordingly, when added to the claims, the numerical value provides express support for claiming the range, which may lie above or below the numerical value, in accordance with the teachings herein. Every value between the minimum value and the maximum value within each numerical range presented herein (including the low, nominal, and high values shown in the chart shown in FIG. 7), is contemplated and expressly supported herein, subject to the number of significant digits expressed in each particular range. Moreover, the application expressly supports the ranges from low to nominal value, from nominal to high value, and from low to high value.

Certain examples of the present disclosure were described above. It is, however, expressly noted that the present disclosure is not limited to those examples, but rather the intention is that additions and modifications to what was expressly described herein are also included within the scope of the disclosed examples. Moreover, it is to be understood that the features of the various examples described herein were not mutually exclusive and may exist in various combinations and permutations, even if such combinations or permutations were not made express herein, without departing from the spirit and scope of the disclosed examples. In fact, variations, modifications, and other implementations of what was described herein will occur to those of ordinary skill in the art without departing from the spirit and the scope of the disclosed examples. As such, the disclosed examples are not to be defined only by the preceding illustrative description.

The foregoing description of examples has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future filed applications claiming priority to this application may claim the disclosed subject matter in a different manner and may generally include any set of one or more limitations as variously disclosed or otherwise demonstrated herein.

What is claimed is:

1. A system for directing water to a subsurface region, comprising:

a network comprising two or more wells, each well comprising:

a conduit for directing a volume of water to a subsurface region located below a land surface, the subsurface region being formed from an earth surface adapted to contact the water and having a hydraulic conductivity of at least $10^{-5}$ cm/s, wherein an upper portion of the subsurface region is located at a distance of at least 35 feet below the land surface, wherein each conduit of the two or more wells is in fluidic communication with each other, and wherein the subsurface region is further formed at least in part from at least one of bedrock, glacial till, and gravel.

2. The system of claim 1, further comprising at least one trench fluidically coupled to the network.

3. The system of claim 2, wherein the at least one trench has a depth of about 6 feet.

4. The system of claim 2, wherein the at least one trench has an exfiltration capacity of about 6 gallons per minute (gpm).

5. The system of claim 1, wherein the network is fluidically connected to a central connector.

6. The system of claim 5, wherein the central connector connects the two or more wells.

7. The system of claim 1, wherein a well of the two or more wells is a drainage well.

8. The system of claim 1, wherein the subsurface region is located in a ground layer of bedrock.

9. The system of claim 1, wherein the conduit is in fluidic communication with a combination of at least a trench and at least a well.

10. The system of claim 1, wherein the two or more wells of the network are positioned around a perimeter of a land structure.

11. A method of directing water to a subsurface region, comprising:

directing a volume of water through a network, the network comprising two or more wells, each well comprising:

a conduit for directing a volume of water to a subsurface region located below a land surface, the subsurface region being formed from an earth surface adapted to contact the water and having a hydraulic conductivity of at least $10^{-5}$ cm/s; and wherein an upper portion of the subsurface region is located at a distance of at least 35 feet below the land surface, wherein each conduit of the two or more wells is in fluidic communication with each other, and wherein the subsurface region is further formed at least in part from at least one of bedrock, glacial till, and gravel.

12. The method of claim 11, further comprising at least one trench fluidically coupled to the network.

13. The method of claim 12, wherein the at least one trench has a depth of about 6 feet.

14. The method of claim 11, wherein the at least one trench has an exfiltration capacity of about 6 gallons per minute (gpm).

15. The method of claim 11, wherein the network is fluidically connected to a central connector.

16. The method of claim 15, wherein the central connector connects the two or more wells.

17. The method of claim 11, wherein a well of the two or more wells is a drainage well.

18. The method of claim 11, wherein the subsurface region is located in a ground layer of bedrock.

19. The method of claim 11, wherein the conduit is in fluidic communication with a combination of at least a trench and at least a well.

20. The method of claim 11, wherein the two or more wells of the network are positioned around a perimeter of a land structure.

21. A system for directing water to a subsurface region, the system comprising:

a network comprising two or more drainage wells, each well comprising:

a conduit for directing a volume of water to a subsurface region below a land surface, the subsurface region being formed from an earth surface adapted to contact the water and having a hydraulic conductivity of at least $10^{-5}$ cm/s, wherein the conduit is adapted to handle fluid volume flows generated during a 100 year storm, wherein each conduit of the two or more wells is in fluidic communication with each other and wherein an upper portion of the subsurface region is located at a distance of at least 35 feet below the land surface, and wherein the subsurface region is further formed at least in part from at least one of bedrock, glacial till, and gravel.

22. The system of claim 21, wherein a well of the two or more wells is a drainage well.

23. A system for directing water to a subsurface region, comprising:

a conduit for directing a volume of water to a subsurface region located below a land surface, the subsurface region being formed from an earth surface adapted to contact the water and having a hydraulic conductivity of at least $10^{-5}$ cm/s, wherein an upper portion of the subsurface region is located at a distance of at least 35 feet below the land surface, and wherein the subsurface region is further formed at least in part from at least one of bedrock, glacial till, and gravel.

* * * * *